US011636871B2

(12) United States Patent
Tao et al.

(10) Patent No.: US 11,636,871 B2
(45) Date of Patent: Apr. 25, 2023

(54) METHOD AND ELECTRONIC APPARATUS FOR DETECTING TAMPERING AUDIO, AND STORAGE MEDIUM

(71) Applicant: INSTITUTE OF AUTOMATION, CHINESE ACADEMY OF SCIENCES, Beijing (CN)

(72) Inventors: Jianhua Tao, Beijing (CN); Shan Liang, Beijing (CN); Shuai Nie, Beijing (CN); Jiangyan Yi, Beijing (CN)

(73) Assignee: INSTITUTE OF AUTOMATION, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/667,212

(22) Filed: Feb. 8, 2022

(65) Prior Publication Data

US 2023/0076251 A1 Mar. 9, 2023

(30) Foreign Application Priority Data

Sep. 8, 2021 (CN) ..... 202111048241.X

(51) Int. Cl.
*G10L 25/51* (2013.01)
*G10L 25/30* (2013.01)
*G10L 25/24* (2013.01)

(52) U.S. Cl.
CPC ..... *G10L 25/51* (2013.01); *G10L 25/24* (2013.01); *G10L 25/30* (2013.01)

(58) Field of Classification Search
CPC ..... G10L 25/51; G10L 25/24; G10L 25/30
See application file for complete search history.

(56) References Cited

U.S. PATENT DOCUMENTS 5,583,961 A * 12/1996 Pawlewski ..... G10L 25/87 704/E11.005
6,665,444 B1 * 12/2003 Kajiwara ..... H04N 19/63 382/233

(Continued)

FOREIGN PATENT DOCUMENTS

CN 110808059 A 2/2020
CN 110853668 A 2/2020
CN 111128133 A 5/2020

OTHER PUBLICATIONS

Balushi et al., Wavelet based Human Voice Identification System, 2017 International Conference on Infocom Technologies and Unmanned Systems (ICTUS), pp. 188-192, Dubai, UAE, dated Dec. 20, 2017.

(Continued)

*Primary Examiner* — Fariba Sirjani
(74) *Attorney, Agent, or Firm* — Westbridge IP LLC

(57) ABSTRACT

Disclosed are a method, an electronic apparatus for detecting tampering audio and a storage medium. The method includes: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order; performing an inverse wavelet transform on the first high-frequency coefficient having an order greater than or equal to a second preset order so as to obtain a first high-frequency component signal corresponding to the signal to be detected; calculating a first Mel cepstrum feature of the first high-frequency component signal in units of frame, and concatenating the first Mel cepstrum features of a current frame signal and a preset number of frame signals.

6 Claims, 4 Drawing Sheets

(56) References Cited

U.S. PATENT DOCUMENTS 8,068,683 B2 * 11/2011 DeCegama ..... H04N 21/6125 382/240
10,089,994 B1 * 10/2018 Radzishevsky ..... G10L 25/51
10,602,270 B1 * 3/2020 Sørensen ..... G10L 21/0208
11,217,076 B1 * 1/2022 Siminoff ..... H04N 7/181
2004/0231498 A1 * 11/2004 Li ..... G06F 16/68 84/634
2006/0227968 A1 * 10/2006 Chen ..... G10L 19/018 704/E19.009
2010/0054701 A1 * 3/2010 DeCegama ..... H04N 19/137 386/252
2013/0253920 A1 * 9/2013 Lin ..... G10L 17/02 704/204
2014/0180673 A1 6/2014 Neuhauser et al.
2015/0088509 A1 * 3/2015 Gimenez ..... G10L 17/22 704/243
2015/0112682 A1 * 4/2015 Rodriguez ..... G10L 17/26 704/249
2016/0154880 A1 * 6/2016 Hoarty ..... G06F 16/7834 707/770
2016/0267632 A1 * 9/2016 Jiang ..... G06T 5/009
2018/0254046 A1 * 9/2018 Khoury ..... G10L 17/06
2019/0362740 A1 * 11/2019 Hauptman ..... G10L 25/66
2020/0035247 A1 * 1/2020 Boyadjiev ..... G06F 21/32
2020/0302949 A1 * 9/2020 Jeong ..... G06N 3/08
2020/0395028 A1 * 12/2020 Kameoka ..... G06N 3/0472
2021/0090553 A1 * 3/2021 Shan ..... G10L 25/27
2021/0193174 A1 * 6/2021 Enzinger ..... G10L 17/06
2021/0233541 A1 * 7/2021 Chen ..... G10L 17/08
2021/0256312 A1 * 8/2021 Komatsu ..... G06N 3/04
2022/0108702 A1 * 4/2022 Sheu ..... G10L 17/06
2022/0165297 A1 * 5/2022 Wang ..... G10L 15/142

OTHER PUBLICATIONS

First Office Action issued in counterpart Chinese Patent Application No. 202111048241.X, dated Oct. 15, 2021.

Kang et al., A hybrid method to convert acoustic features for voice conversion, Acta Acustica, pp. 555-561, vol. 31, No. 6, dated Nov. 30, 2006.

Kumar et al., Classification of Voiced and Non-voiced Speech Signals using Empirical Wavelet Transform and Multi-level Local Patterns, 2015 IEEE International Conference on Digital Signal Processing (DSP), pp. 163-167, Singapore, dated Jul. 24, 2015.

Zheng et al., Audio classification based on wavelet transform and support vector machine, Journal of Chongqing University of Posts and Telecommunications (Natural Science Edition), pp. 212-216, vol. 20, No. 2, Chongqing, China, dated Apr. 15, 2008.

* cited by examiner

METHOD AND ELECTRONIC APPARATUS FOR DETECTING TAMPERING AUDIO, AND STORAGE MEDIUM

CROSS-REFERENCE TO RELATED APPLICATIONS

The present disclosure claims priority to Chinese Patent Application 202111048241.X entitled "Method, device, and electronic apparatus for detecting tampering audio and storage medium" filed on Sep. 8, 2021, the entire content of which is incorporated herein by reference.

TECHNICAL FIELD

The present disclosure relates to a field of voice recognition, and particular to a method, an electronic apparatus for detecting tampering audio and a storage medium.

BACKGROUND OF THE INVENTION

The main principle of detecting the tampering audio is that an audio file will record inherent characteristics (such as a microphone noise) of a recording device or inherent information of software such as audio processing (compression, denoising) during a recording process. In an original file that has not been tampered with, such inherent information will not change over time, and statistics information is stable. At present, common solutions for detecting the tampering audio include performing tampering forensics based on a difference in energy distribution of background noise, and performing tampering forensics based on recording environment recognition of an environmental reverberation, and the like. However, those solutions are only effective for files in a certain compression format, and may not have an extensive use to all audio formats. In another train of thought, part of the tampering audio has undergone a secondary compression. The purpose of tampering identification and positioning may be achieved by detecting a frame offset of sampling points due to the secondary compression. However, some tampering audio data is not subjected to the secondary compression, and the tampering identification and positioning may not be effectively processed by means of the frame offset.

In the process of implementing the concept of the present disclosure, the inventor found that at least the following technical problems existed in the related art: the application scenarios of the existing methods for detecting tampering audio are limited, and may not be used in some scenarios.

SUMMARY OF THE INVENTION

In order to solve the above technical problems or at least partially solve the above technical problems, the embodiments of the present disclosure provide a method, a device, and an electronic apparatus for detecting tampering audio and a storage medium, so as to at least solve the problems that the application scenarios of the existing methods for detecting tampering audio are limited, and may not be used in some scenarios in the prior art.

The purpose of the present disclosure is implemented by following technical solutions.

In a first aspect, the present disclosure provides a method for detecting tampering audio, and the method includes: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order; performing an inverse wavelet transform on the first high-frequency coefficient having an order greater than or equal to a second preset order so as to obtain a first high-frequency component signal corresponding to the signal to be detected; calculating a first Mel cepstrum feature of the first high-frequency component signal in units of frame, and concatenating the first Mel cepstrum features of a current frame signal and a preset number of frame signals before the current frame signal of the first high-frequency component signal so as to obtain a first concatenating feature; and performing a detection of the tampering audio on the first concatenating feature by means of a deep learning model, where the deep learning model has been trained, has learned and stored a correspondence between the first concatenating feature of the frame signals and whether the frame signals belong to the tampering audio.

In an exemplary embodiment, calculating the first Mel cepstrum feature of the first high-frequency component signal in units of frame includes: performing a fast Fourier transform on the first high-frequency component signal so as to obtain a transformation result; calculating a second Mel cep strum feature of the transformation result in units of frame; and performing a discrete cosine transform on the second Mel cepstrum feature so as to obtain the first Mel cepstrum feature.

In an exemplary embodiment, calculating the second Mel cepstrum feature of the transformation result in units of frame includes calculating the second Mel cepstrum feature of the transformation result according to the following formula:

$$X_{Mel}(i) = \log\left(\sum_{f=1}^{F} H_i(f)|X(f)|^2\right),\ 1 \le i \le a,$$

where, X(f) is the FFT transformation result; |X(f)| is a norm operation of X(f); F is the number of frequency bands; f is a serial number of the frequency bands; i is a serial number of a Mel filter; $H_i(f)$ is a value of an i-th Mel filter in an f-th frequency band; a is a positive integer greater than 1; and $X_{Mel}(i)$ is the second Mel cepstrum feature corresponding to the i-th Mel filter.

In an exemplary embodiment, performing the discrete cosine transform on the second Mel cepstrum feature so as to obtain the first Mel cepstrum feature includes performing the discrete cosine transform on the second Mel cepstrum feature according to the following formula:

$$X_C(l) = \sum_{i=1}^{a} X_{Mel}(i)\cos\left(\frac{\pi l(i-1.5)}{a}\right),\ 1 \le l \le b$$

where, i is a serial number of the Mel filter; $X_{Mel}(i)$ is the second Mel cepstrum feature corresponding to the i-th Mel filter; a and b are both positive integer greater than 1; l is a feature index of the second Mel cepstrum feature; and $X_C(l)$ is the first Mel cepstrum feature when the value of the feature index is 1.

In an exemplary embodiment, the method includes: acquiring a training signal, and performing the wavelet transform of the first preset order on the training signal so as to obtain a second low-frequency coefficient and a second high-frequency coefficient corresponding to the training signal, the number of which is equal to that of the first preset order; performing the inverse wavelet transform on the second high-frequency coefficient having an order greater than or equal to the second preset order so as to obtain a second high-frequency component signal corresponding to the training signal; calculating a third Mel cepstrum feature of the second high-frequency component signal in units of frame, and concatenating the third Mel cepstrum features of a current frame signal and a preset number of frame signals before the current frame signal of the second high-frequency component signal so as to obtain a second concatenating feature; and labeling the second concatenating feature according to the training signal and training the deep learning model according to the second concatenating feature that have been subjected to labeling.

In an exemplary embodiment, before performing the fast Fourier transform on the first high-frequency component signal so as to obtain the transformation result, the method further includes: constructing a down-sampling filter using an interpolation algorithm, where the down-sampling filter adopts a preset threshold as a multiple of down-sampling; and filtering the first high-frequency component signal according to the down-sampling filter.

In an exemplary embodiment, performing the inverse wavelet transform on the first high-frequency coefficient having the order greater than or equal to the second preset order so as to obtain the first high-frequency component signal corresponding to the signal to be detected includes: setting each of the first low-frequency coefficients to zero, and setting the first high-frequency coefficient having the order less than the second preset order to zero; and performing the inverse wavelet transform on the first high-frequency coefficient having the order greater than or equal to the second preset order so as to obtain the first high-frequency component signal.

In a second aspect, the present disclosure provides a device for detecting tampering audio, and the device includes: a first transformation module configured to acquire a signal to be detected, and perform a wavelet transform of a first preset order on the signal to be detected so as to obtain a first low-frequency coefficient and a first high-frequency coefficient corresponding to the signal to be detected, the number of which is equal to that of the first preset order; a second transformation module configured to perform an inverse wavelet transform on the first high-frequency coefficient having an order greater than or equal to a second preset order so as to obtain a first high-frequency component signal corresponding to the signal to be detected; a calculation module configured to calculate a first Mel cepstrum feature of the first high-frequency component signal in units of frame, and concatenate the first Mel cepstrum feature of a current frame signal and a preset number of frame signals before the current frame signal of the first high-frequency component signal so as to obtain a first concatenating feature; and a detection module configured to perform a detection of the tampering audio on the first concatenating feature by means of a deep learning model, where the deep learning model has been trained, has learned and stored a correspondence between the first concatenating feature of the frame signals and whether the frame signals belong to the tampering audio.

In a third aspect, the present disclosure provides an electronic apparatus including a processor, a communication interface, a memory, and a communication bus. Among them, the processor, the communication interface, and the memory communicate with each other through the communication bus. The memory is configured to store computer programs, and the processor is configured to execute the computer programs stored on the memory so as to implement the method for detecting tampering audio as described above.

In a fourth aspect, the present disclosure provides a computer-readable storage medium. The computer programs, which implement the method for detecting tampering audio as described above when executed by the processor, are stored on the above-mentioned computer-readable storage medium.

Compared with the prior art, the above-mentioned technical solutions provided by the embodiments of the present disclosure have at least some or all of the following advantages: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order; performing an inverse wavelet transform on the first high-frequency coefficient having an order greater than or equal to a second preset order so as to obtain a first high-frequency component signal corresponding to the signal to be detected; calculating a first Mel cepstrum feature of the first high-frequency component signal in units of frame, and concatenating the first Mel cepstrum features of a current frame signal and a preset number of frame signals before the current frame signal of the first high-frequency component signal so as to obtain a first concatenating feature; and performing a detection of the tampering audio on the first concatenating feature by means of a deep learning model, where the deep learning model has been trained, has learned and stored a correspondence between the first concatenating feature of the frame signals and whether the frame signals belong to the tampering audio. In the embodiments of the present discourse, due to that the wavelet transform and the inverse wavelet transform are performed sequentially on the signal to be detected to finally obtain the first high-frequency component signal corresponding to the signal to be detected; the first Mel cepstrum feature of the first high-frequency component signal is calculated in units of frame and the first Mel cepstrum feature of a plurality of frame signals are concatenated so as to obtain the first concatenating feature; and the detection of the tampering audio is performed on the first concatenating feature by means of the deep learning model, the problems that the application scenarios of the existing methods for detecting tampering audio are limited, and may not be used in some scenarios in the prior art may be solved by adopting the above-mentioned technical solutions, thereby providing a new method for detecting tampering audio.

BRIEF DESCRIPTION OF THE DRAWINGS

The accompanying drawings herein, which are incorporated into the specification and constitute a part of the specification, show embodiments in accordance with the present disclosure and are used to explain the principle of the present disclosure together with the specification.

In order to more clearly describe the technical solutions in the embodiments of the present disclosure or the prior art, the accompanying drawings necessarily used for the description of the embodiments or related art will be briefly introduced in the following. It is obvious for those of ordinary skill in the art to obtain other accompanying drawings from these accompanying drawings without paying creative labor.

DETAILED DESCRIPTION OF THE INVENTION

Hereinafter, the present disclosure will be described in detail with reference to the accompanying drawings and in conjunction with the embodiments. It should be noted that the embodiments and the features in the embodiments in the present disclosure may be combined with each other without conflicts.

It should be noted that the terms "first" and "second" in the specification and claims of the present disclosure as well as the above-mentioned accompanying drawings are used to distinguish similar objects, and not necessarily used to describe a specific sequence or order.

Figure 1:
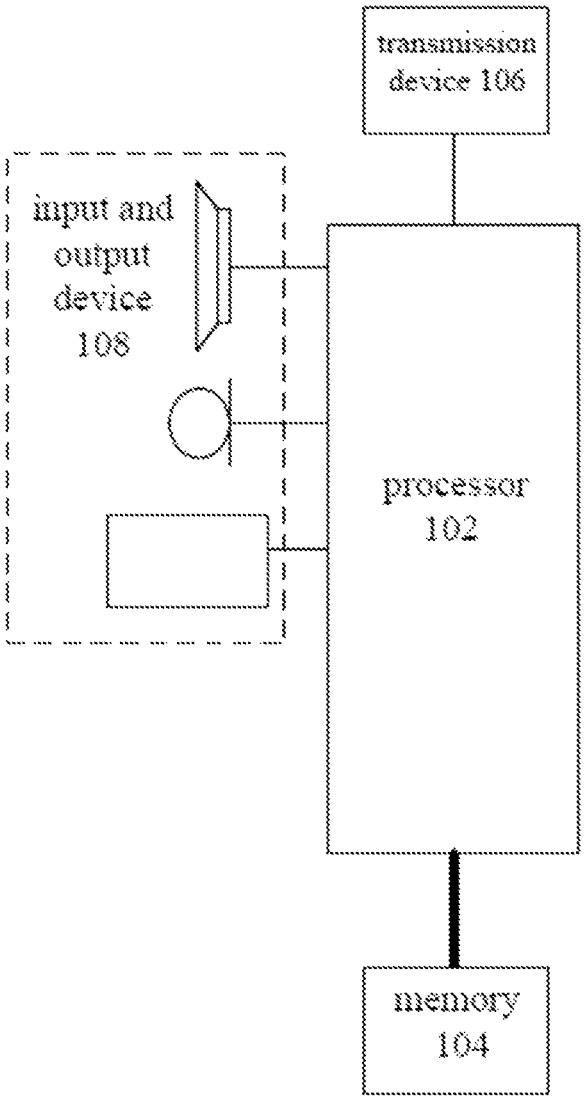
FIG. 1 schematically illustrates a structural block diagram of a hardware of a computer terminal of a method for detecting tampering audio according to an embodiment of the present disclosure.

The method embodiment provided in the embodiments of the present disclosure may be executed in a computer terminal or similar computing device. Taking running on a computer terminal as an example, FIG. 1 schematically illustrates a structural block diagram a hardware of a computer terminal of a method for detecting tampering audio according to an embodiment of the present disclosure. As shown in FIG. 1, the computer terminal may include processing devices such as one or more processors 102 (only one is shown in FIG. 1) (the processor 102 may include, but is not limited to, a microprocessor (Microprocessor Unit, MPU for short) or programmable logic device (PLD for short)) and a memory 104 for storing data. Alternately, the above-mentioned computer terminal may also include a transmission device 106 for communication functions and an input and output device 108. Those of ordinary skill in the art may appreciate that the structure shown in FIG. 1 is merely schematically, which does not limit the structure of the above-mentioned computer terminal. For example, the computer terminal may also include more or less components than those shown in FIG. 1, or may have configurations with equivalent functions of those shown in FIG. 1, or have more different configurations with more functions than those shown in FIG. 1.

The memory 104 may be used to store computer programs, for example, software programs and modules of application software, such as the computer programs corresponding to the method for detecting tampering audio in the embodiment of the present disclosure. The above-mentioned method is realized by the processor 102 running the computer programs stored in the memory 104 so as to execute various functional applications and data processing. The memory 104 may include a high-speed random access memory, and may also include a non-volatile memory, such as one or more magnetic storage devices, flash memory, or other non-volatile solid-state memory. In some examples, the memory 104 may further include a memory remotely provided with respect to the processor 102, and these remote memories may be connected to the computer terminal through a network. Examples of the above-mentioned network include, but are not limited to, the Internet, corporate intranets, local area networks, mobile communication networks, and combinations thereof.

The transmission device 106 is used to receive or transmit data via a network. Specific examples of the above-mentioned network include a wireless network provided by a communication provider of the computer terminal. In an example, the transmission device 106 includes a network adapter (Network Interface Controller, NIC for short), which may be connected to other network devices through a base station so as to communicate with the Internet. In an example, the transmission device 106 may be a radio frequency (RF for short) module, which is used to communicate with the Internet in a wireless manner.

Figure 2:
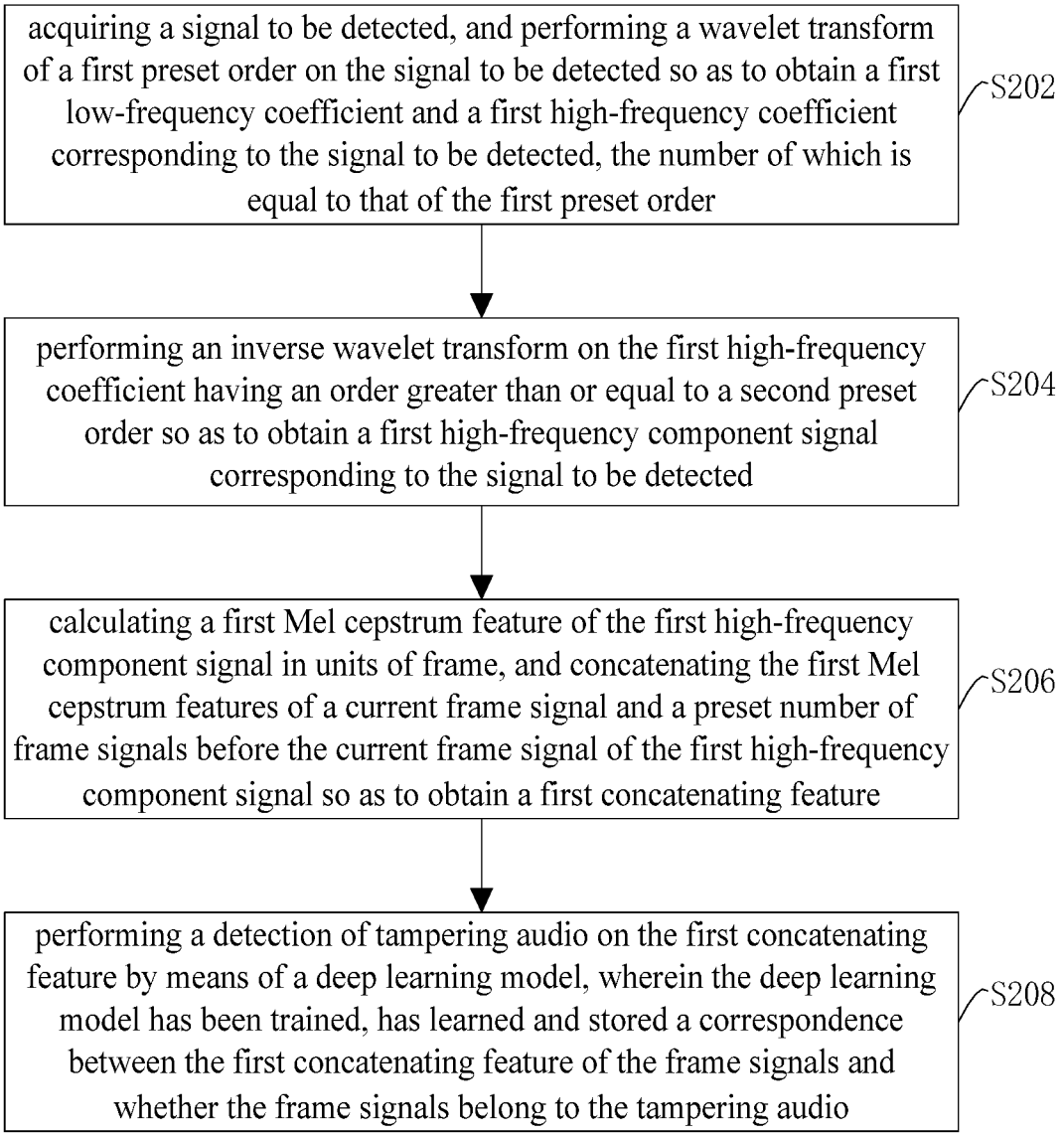
FIG. 2 schematically illustrates a flowchart of a method for detecting the tampering audio according to an embodiment of the present disclosure.

The embodiment of the present disclosure provides a method for detecting tampering audio. FIG. 2 schematically illustrates a flowchart of the method for detecting the tampering audio according to the embodiment of the present disclosure. As shown in FIG. 2, the process includes the following steps:

step S202: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order;

step S204: performing an inverse wavelet transform on the first high-frequency coefficient having an order greater than or equal to a second preset order so as to obtain a first high-frequency component signal corresponding to the signal to be detected;

step S206: calculating a first Mel cepstrum feature of the first high-frequency component signal in units of frame, and concatenating the first Mel cepstrum features of a current frame signal and a preset number of frame signals before the current frame signal of the first high-frequency component signal so as to obtain a first concatenating feature; and step S208: performing a detection of the tampering audio on the first concatenating feature by means of a deep learning model, where the deep learning model has been trained, has learned and stored a correspondence between the first concatenating feature of the frame signals and whether the frame signals belong to the tampering audio.

In the present disclosure, the signal to be detected is acquired, and the wavelet transform of the first preset order is performed on the signal to be detected so as to obtain the first low-frequency coefficient and the first high-frequency coefficient corresponding to the signal to be detected, the number of which is equal to that of the first preset order; the inverse wavelet transform is performed on the first high-frequency coefficient having an order greater than or equal to the second preset order so as to obtain the first high-frequency component signal corresponding to the signal to be detected; the first Mel cepstrum feature of the first high-frequency component signal is calculated in units of frame, and the first Mel cepstrum features of a current frame signal and a preset number of frame signals before the current frame signal of the first high-frequency component signal are concatenated so as to obtain a first concatenating feature; and the detection of the tampering audio on the first concatenating feature is performed by means of the deep learning model, where the deep learning model has been trained, has learned and stored a correspondence between the first concatenating feature of the frame signals and whether the frame signals belong to the tampering audio. In the embodiment of the present disclosure, due to that the wavelet transform and the inverse wavelet transform are sequentially performed on the signal to be detected to finally obtain the first high-frequency component signal corresponding to the signal to be detected; the first Mel cepstrum feature of the first high-frequency component signal is calculated in units of frame and the first Mel cepstrum features of a plurality of frame signals are concatenated so as to obtain the first concatenating feature; and the detection of the tampering audio is performed on the first concatenating feature by means of the deep learning model, the problems that the application scenarios of the existing methods for detecting tampering audio are limited, and may not be used in some scenarios in the prior art may be solved by adopting the above-mentioned technical solutions, thereby providing a new method for detecting tampering audio.

In step S206, calculating the first Mel cepstrum feature of the first high-frequency component signal in units of frame includes: performing a fast Fourier transform on the first high-frequency component signal so as to obtain a transformation result; calculating a second Mel cep strum feature of the transformation result in units of frame; and performing a discrete cosine transform on the second Mel cepstrum feature so as to obtain the first Mel cepstrum feature.

The fast Fourier transform on the first high-frequency component signal may be performed by the following formula:

$$X(f) = \sum_{n=1}^{N} x(n)\exp\left(-j\frac{2\pi fn}{N}\right),$$

where, f represents a frequency band, j represents an imaginary number unit, N is a frame length, n is a time label of the first high-frequency component signal, and exp is an exponential function with a natural constant e as a base number. It should be noted that before performing the fast Fourier transform on the first high-frequency component signal so as to obtain the transformation result, the first high-frequency component signal may also be subjected to a frame splitting operation.

It should be noted that the purpose of the discrete cosine change is to remove redundant components, and if the discrete cosine change is not performed, only the accuracy of the result will be affected. Therefore, after calculating the second Mel cepstrum feature of the transformation result in units of frame, the discrete cosine transform may not be performed on the second Mel cepstrum feature, and the second Mel cepstrum feature may be seen as the first Mel cepstrum feature directly.

Calculating the second Mel cepstrum feature of the transformation result in units of frame includes: calculating the second Mel cepstrum feature of the transformation result according to the following formula:

$$X_{Mel}(i) = \log\left(\sum_{f=1}^{F} H_i(f)|X(f)|^2\right), 1 \le i \le a,$$

where, X(f) is the transformation result; |X(f)| is a norm operation of X(f); F is the number of frequency bands; f is a serial number of the frequency bands; i is a serial number of a Mel filter; $H_i(f)$ is a value of an i-th Mel filter in an f-th frequency band; a is a positive integer greater than 1; and $X_{Mel}(i)$ is the second Mel cepstrum feature corresponding to the i-th Mel filter.

Calculating the second Mel cepstrum feature of the transformation result is actually performing a Mel filtering operation on the transformation result, where i is the serial number of the Mel filter and at the same time, it also represents the dimension of the MEL filtering. That is, if the filtering has n Mel filters, the filtering may be called an n-dimension MEL filtering. For example, if i is 23, the present filtering uses 23 Mel filters and the present filtering may be called a 23-dimension MEL filtering.

Performing the discrete cosine transform on the second Mel cepstrum feature so as to obtain the first Mel cepstrum feature includes performing the discrete cosine transform on the second Mel cepstrum feature according to the following formula:

$$X_C(l) = \sum_{i=1}^{a} X_{Mel}(i)\cos\left(\frac{\pi l(i-1.5)}{a}\right), 1 \le l \le b$$

where, i is a serial number of the Mel filter; $X_{Mel}(i)$ is the second Mel cepstrum feature corresponding to the i-th Mel filter; a and b are both positive integer greater than 1; l is a feature index of the second Mel cepstrum feature; and $X_C(l)$ is the first Mel cepstrum feature when the value of the feature index is 1.

Specifically, l is the feature index of the second Mel cepstrum feature, which fully reflects the energy distribution of the high-frequency components, for example, l being 12 represents the feature index of a 12-dimension second Mel cepstrum feature.

In step 208, the following steps are performed: acquiring a training signal, and performing the wavelet transform of the first preset order on the training signal so as to obtain a second low-frequency coefficient and a second high-frequency coefficient corresponding to the training signal, the number of which is equal to that of the first preset order; performing the inverse wavelet transform on the second high-frequency coefficient having an order greater than or equal to the second preset order so as to obtain a second high-frequency component signal corresponding to the training signal; calculating a third Mel cepstrum feature of the second high-frequency component signal in units of frame, and concatenating the third Mel cepstrum features of a current frame signal and a preset number of frame signals before the current frame signal of the second high-frequency component signal so as to obtain a second concatenating feature; and labeling the second concatenating feature according to the training signal and training the deep learning model according to the second concatenating feature that have been subjected to labeling.

In the embodiment of the present disclosure, the deep learning model is trained by means of the second concatenating features of the current frame signal and a preset number of frame signals before the current frame signal of the second high-frequency component signal, which have been subjected to labeling, such that the deep learning model has learned the correspondence between the concatenating feature of the frame signals and whether the frame signals belong to the tampering audio, thereby achieving the detection on the tampering audio. Specifically, the correspondence between the concatenating feature and whether the frame signals belong to the tampering audio should be understood as a correspondence between the concatenating feature and the tampering audio. In labeling the second concatenating feature according to the training signal, a tag of the second concatenating feature without the tampering audio may be labeled as 1, and a tag of the second concatenating feature with the tampering audio may be labeled as 0.

Before step 206, that is, before performing a fast Fourier transform on the first high-frequency component signal so as to obtain a transformation result, the method further includes: constructing a down-sampling filter using an interpolation algorithm, where the down-sampling filter adopts a preset threshold as a multiple of down-sampling; and filtering the first high-frequency component signal according to the down-sampling filter.

The interpolation algorithm is an interpolation algorithm of discrete time sequence. The redundant information may be removed by constructing the down-sampling filter adopting the preset threshold as the multiple of down-sampling according to the interpolation algorithm and filtering the first high-frequency component signal according to the down-sampling filter.

In step 206, performing the inverse wavelet transform on the first high-frequency coefficient having the order greater than or equal to the second preset order so as to obtain the first high-frequency component signal corresponding to the signal to be detected includes: setting each of the first low-frequency coefficients to zero, and setting the first high-frequency coefficient having the order less than the second preset order to zero; and performing the inverse wavelet transform on the first high-frequency coefficient having the order greater than or equal to the second preset order so as to obtain the first high-frequency component signal.

The wavelet transform of the first preset order on the signal to be detected may be performed by the following formula:

$$(a_1,a_2,\ldots,a_K,b_1,b_2,\ldots,b_K)=\Gamma(y(n),K)$$

where, y(n) is the signal to be detected; Γ(y(n),K) represents a K-order wavelet transform on the signal y(n); $a_k$ and $b_k$ respectively represent a k-th order low-frequency coefficient and high-frequency coefficient of the signal y(n) being subjected to the wavelet transform, k is a positive integer, and n is the serial number of the tag of the signal to be detected. Specifically, the wavelet basis function adopts the 6-order Daubechies basis function, and the value of K may range between 10-13.

The first low-frequency coefficient is set to zero by the following formula:

$$\hat{a}_k=0,(k=1,2,\ldots,K).$$

The first high-frequent coefficient having the order less than the second preset order is set to zero by the following formula:

$$\hat{b}_k=0,(k=1,2,\ldots,K-1).$$

In terms of effect, setting the first high-frequency coefficient having the order less than the second preset order to zero is equivalent to the following formula:

$$\hat{b}_K=b_K.$$

After setting each of the first low-frequency coefficients to zero and setting the first high-frequency coefficient having the order less than the second preset order to zero, the inverse wavelet transform is performed on the first high-frequency coefficient having the order greater than or equal to the second preset order by the following formula:

$$\hat{y}_{H,K}(n)=\Gamma^{-1}(\hat{a}_1,\hat{a}_2,\ldots,\hat{a}_K,\hat{b}_1,\hat{b}_2,\ldots,\hat{b}_K)$$

where, $\hat{y}_{H,K}(n)$ is the first high-frequency component signal corresponding to the signal to be detected.

In order to better understand the above-mentioned technical solution, the embodiment of the present disclosure also provides an alternative embodiment for explaining the above-mentioned technical solution.

Figure 3:
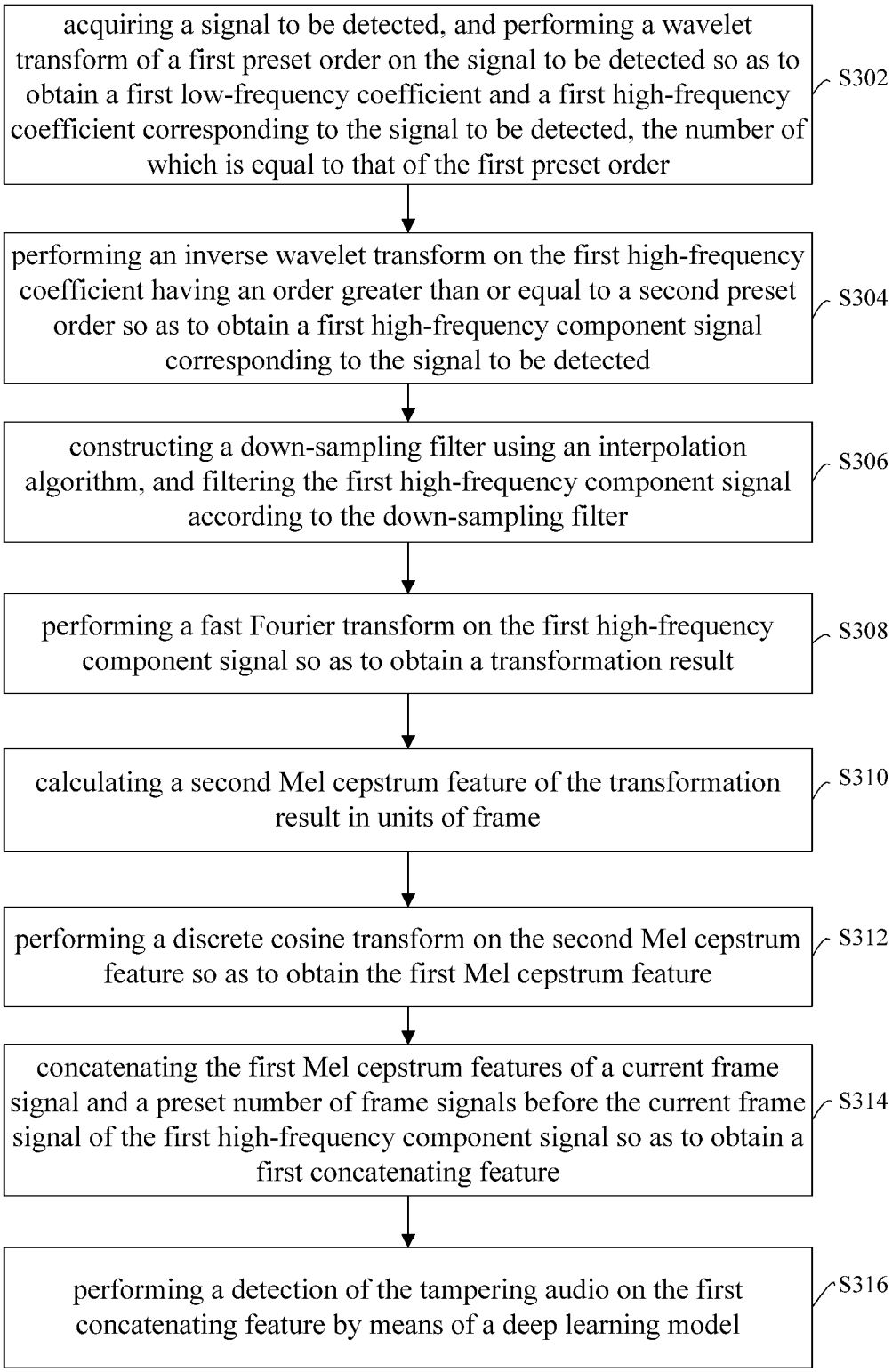
FIG. 3 schematically illustrates a schematic flowchart of a method for detecting the tampering audio according to an embodiment of the present disclosure.

FIG. 3 schematically illustrates a schematic flowchart of a method for detecting the tampering audio according to an embodiment of the present disclosure, and FIG. 3 shows:

S302: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order;

S304: performing an inverse wavelet transform on the first high-frequency coefficient having an order greater than or equal to a second preset order so as to obtain a first high-frequency component signal corresponding to the signal to be detected;

S306: constructing a down-sampling filter using an interpolation algorithm, and filtering the first high-frequency component signal according to the down-sampling filter;

S308: performing a fast Fourier transform on the first high-frequency component signal so as to obtain a transformation result;

S310: calculating a second Mel cepstrum feature of the transformation result in units of frame;

S312: performing a discrete cosine transform on the second Mel cepstrum feature so as to obtain the first Mel cepstrum feature;

S314: concatenating the first Mel cepstrum features of a current frame signal and a preset number of frame signals before the current frame signal of the first high-frequency component signal so as to obtain a first concatenating feature; and S316: performing a detection of the tampering audio on the first concatenating feature by means of a deep learning model.

In the present disclosure, the signal to be detected is acquired, and the wavelet transform of the first preset order is performed on the signal to be detected so as to obtain the first low-frequency coefficient and the first high-frequency coefficient corresponding to the signal to be detected, the number of which is equal to that of the first preset order; the inverse wavelet transform is performed on the first high-frequency coefficient having an order greater than or equal to the second preset order so as to obtain the first high-frequency component signal corresponding to the signal to be detected; the first Mel cepstrum feature of the first high-frequency component signal is calculated in units of frame, and the first Mel cepstrum features of a current frame signal and a preset number of frame signals before the current frame signal of the first high-frequency component signal are concatenated so as to obtain a first concatenating feature; and the detection of the tampering audio on the first concatenating feature is performed by means of the deep learning model, where the deep learning model has been trained, has learned and stored a correspondence between the first concatenating feature of the frame signals and whether the frame signals belong to the tampering audio. In the embodiment of the present disclosure, due to that the wavelet transform and the inverse wavelet transform are sequentially performed on the signal to be detected to finally obtain the first high-frequency component signal corresponding to the signal to be detected; the first Mel cepstrum feature of the first high-frequency component signal is calculated in units of frame and the first Mel cepstrum features of a plurality of frame signals are concatenated so as to obtain the first concatenating feature; and the detection of the tampering audio is performed on the first concatenating feature by means of the deep learning model, the problems that the application scenarios of the existing methods for detecting tampering audio are limited, and may not be used in some scenarios in the prior art may be solved by adopting the above-mentioned technical solutions, thereby providing a new method for detecting tampering audio.

Through the description of the above embodiments, those of ordinary skill in the art can clearly understand that the method according to the above embodiments may be implemented by means of software plus necessary general hardware platform, or of course by means of hardware, but in many cases the former is a better implementation. Based on such understanding, the technical solution of the present disclosure essentially or the part that contributes to the prior art can be embodied in the form of a software product, and the computer software product is stored in a storage medium (such as a Read-Only Memory (ROM for short), a Random Access Memory (RAM for short), a magnetic disk, an optical disk), and includes several instructions to cause a terminal device (which may be a mobile phone, a computer, a component server, or a network equipment, etc.) to perform various embodiments of the present disclosure.

In an embodiment of the present disclosure, a device for detecting the tampering audio is further provided. The device for detecting the tampering audio is utilized to implement the above-mentioned embodiments and preferred implementations, and what has been described will not be repeated. As used below, the term "module" may be implemented as a combination of software and/or hardware with predetermined functions. Although the devices described in the following embodiments are preferably implemented by software, implementation by hardware or a combination of software and hardware is also possible and conceived.

Figure 4:
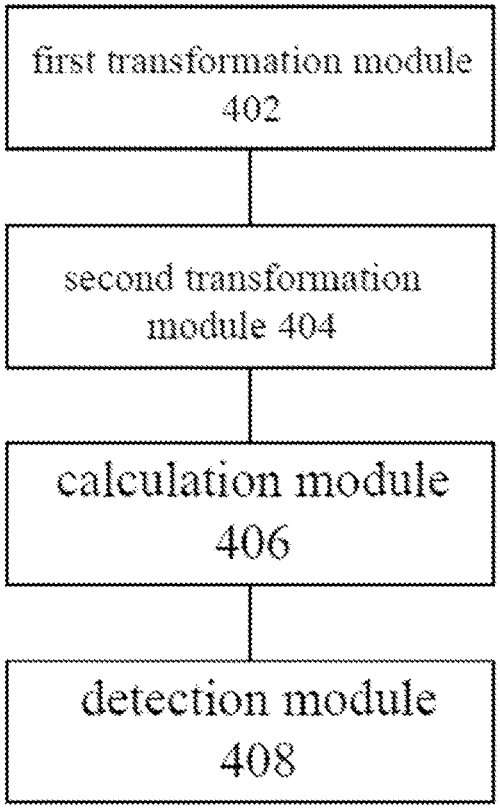
FIG. 4 schematically illustrates a structural block diagram of a device for detecting the tampering audio according to an embodiment of the present disclosure.

FIG. 4 schematically illustrates a structural block diagram of a device for detecting the tampering audio according to an embodiment of the present disclosure, and as shown in FIG. 4, the device includes:

a first transformation module 402 configured to acquire a signal to be detected, and perform a wavelet transform of a first preset order on the signal to be detected so as to obtain a first low-frequency coefficient and a first high-frequency coefficient corresponding to the signal to be detected, the number of which is equal to that of the first preset order;

a second transformation module 404 configured to perform an inverse wavelet transform on the first high-frequency coefficient having an order greater than or equal to a second preset order so as to obtain a first high-frequency component signal corresponding to the signal to be detected;

a calculation module 406 configured to calculate a first Mel cepstrum feature of the first high-frequency component signal in units of frame, and concatenate the first Mel cepstrum features of a current frame signal and a preset number of frame signals before the current frame signal of the first high-frequency component signal so as to obtain a first concatenating feature; and a detection module 408 configured to perform a detection of the tampering audio on the first concatenating feature by means of a deep learning model, where the deep learning model has been trained, has learned and stored a correspondence between the first concatenating feature of the frame signals and whether the frame signals belong to the tampering audio.

In the present disclosure, the signal to be detected is acquired, and the wavelet transform of the first preset order is performed on the signal to be detected so as to obtain the first low-frequency coefficient and the first high-frequency coefficient corresponding to the signal to be detected, the number of which is equal to that of the first preset order; the inverse wavelet transform is performed on the first high-frequency coefficient having an order greater than or equal to the second preset order so as to obtain the first high-frequency component signal corresponding to the signal to be detected; the first Mel cepstrum feature of the first high-frequency component signal is calculated in units of frame, and the first Mel cepstrum features of a current frame signal and a preset number of frame signals before the current frame signal of the first high-frequency component signal are concatenated so as to obtain a first concatenating feature; and the detection of the tampering audio on the first concatenating feature is performed by means of the deep learning model, where the deep learning model has been trained, has learned and stored a correspondence between the first concatenating feature of the frame signals and whether the frame signals belong to the tampering audio. In the embodiment of the present disclosure, due to that the wavelet transform and the inverse wavelet transform are sequentially performed on the signal to be detected to finally obtain the first high-frequency component signal corresponding to the signal to be detected; the first Mel cepstrum feature of the first high-frequency component signal is calculated in units of frame and the first Mel cepstrum features of a plurality of frame signals are concatenated so as to obtain the first concatenating feature; and the detection of the tampering audio is performed on the first concatenating feature by means of the deep learning model, the problems that the application scenarios of the existing methods for detecting tampering audio are limited, and may not be used in some scenarios in the prior art may be solved by adopting the above-mentioned technical solutions, thereby providing a new method for detecting tampering audio.

Alternately, the calculation module 406 is further configured to perform a fast Fourier transform on the first high-frequency component signal so as to obtain a transformation result; calculate a second Mel cepstrum feature of the transformation result in units of frame; and perform a discrete cosine transform on the second Mel cepstrum feature so as to obtain the first Mel cepstrum feature.

Alternately, the calculation module 406 is further configured to perform the fast Fourier transform on the first high-frequency component signal by the following formula:

$$X(f) = \sum_{n=1}^{N} x(n)\exp\left(-j\frac{2\pi fn}{N}\right),$$

where, f represents a frequency band, j represents an imaginary number unit, N is a frame length, n is a time label of the first high-frequency component signal, and exp is an exponential function with a natural constant e as a base number. It should be noted that before performing the fast Fourier transform on the first high-frequency component signal so as to obtain the transformation result, the first high-frequency component signal may also be subjected to a frame splitting operation.

It should be noted that the purpose of the discrete cosine change is to remove redundant components, and if the discrete cosine change is not performed, only the accuracy of the result will be affected. Therefore, after calculating the second Mel cepstrum feature of the transformation result in units of frame, the discrete cosine transform may not be performed on the second Mel cepstrum feature, and the second Mel cepstrum feature may be seen as the first Mel cepstrum feature directly.

Alternately, the calculation module 406 is further configured to calculate the second Mel cepstrum feature of the transformation result in units of frame, which includes calculating the second Mel cepstrum feature of the transformation result according to the following formula:

$$X_{Mel}(i) = \log\left(\sum_{f=1}^{F} H_i(f)|X(f)|^2\right), 1 \le i \le a,$$

where, X(f) is the transformation result; |X(f)| is a norm operation of X(f); F is the number of frequency bands; f is a serial number of the frequency bands; i is a serial number of a Mel filter; Hi(f) is a value of an i-th Mel filter in an f-th frequency band; a is a positive integer greater than 1; and $X_{Mel}(i)$ is the second Mel cepstrum feature corresponding to the i-th Mel filter.

Calculating the second Mel cepstrum feature of the transformation result is actually performing a Mel filtering operation on the transformation result, where i is the serial number of the Mel filter and at the same time, it also represents the dimension of the MEL filtering. That is, if the filtering has n Mel filters, the filtering may be called an n-dimension MEL filtering. For example, if i is 23, the present filtering uses 23 Mel filters and the present filtering may be called a 23-dimension MEL filtering.

Alternately, the calculation module 406 is further configured to perform the discrete cosine transform on the second Mel cepstrum feature according to the following formula:

$$X_C(l) = \sum_{i=1}^{a} X_{Mel}(i)\cos\left(\frac{\pi l(i-1.5)}{a}\right), 1 \le l \le b$$

where, i is a serial number of the Mel filter; $X_{Mel}(i)$ is the second Mel cepstrum feature corresponding to the i-th Mel filter; a and b are both positive integer greater than 1; l is a feature index of the second Mel cepstrum feature; and $X_C(l)$ is the first Mel cepstrum feature when the value of the feature index is 1.

Specifically, l is the feature index of the second Mel cepstrum feature, which fully reflects the energy distribution of the high-frequency components, for example, l being 12 represents the feature index of a 12-dimension second Mel cepstrum feature.

Alternately, the detection module 408 is further configured to acquire a training signal, and perform the wavelet transform of the first preset order on the training signal so as to obtain a second low-frequency coefficient and a second high-frequency coefficient corresponding to the training signal, the number of which is equal to that of the first preset order; perform the inverse wavelet transform on the second high-frequency coefficient having an order greater than or equal to the second preset order so as to obtain a second high-frequency component signal corresponding to the training signal; calculate a third Mel cepstrum feature of the second high-frequency component signal in units of frame, and concatenate the third Mel cepstrum features of a current frame signal and a preset number of frame signals before the current frame signal of the second high-frequency component signal so as to obtain a second concatenating feature; and label the second concatenating feature according to the training signal and train the deep learning model according to the second concatenating feature that have been subjected to labeling.

In the embodiment of the present disclosure, the deep learning model is trained by means of the second concatenating features of the current frame signal and a preset number of frame signals before the current frame signal of the second high-frequency component signal, which have been subjected to labeling, such that the deep learning model has learned the correspondence between the concatenating feature of the frame signals and whether the frame signals belong to the tampering audio, thereby achieving the detection on the tampering audio. Specifically, the correspondence between the concatenating feature and whether the frame signals belong to the tampering audio should be understood as a correspondence between the concatenating feature and the tampering audio. In labeling the second concatenating feature according to the training signal, a tag of the second concatenating feature without the tampering audio may be labeled as 1, and a tag of the second concatenating feature with the tampering audio may be labeled as 0.

Alternately, the calculation module 406 is further configured to construct a down-sampling filter using an interpolation algorithm, where the down-sampling filter adopts a preset threshold as a multiple of down-sampling; and filter the first high-frequency component signal according to the down-sampling filter.

The interpolation algorithm is an interpolation algorithm of discrete time sequence. The redundant information may be removed by constructing the down-sampling filter adopting the preset threshold as the multiple of down-sampling according to the interpolation algorithm and filtering the first high-frequency component signal according to the down-sampling filter.

Alternately, the calculation module 406 is further configured to set each of the first low-frequency coefficients to zero, and set the first high-frequency coefficient having the order less than the second preset order to zero; and perform the inverse wavelet transform on the first high-frequency coefficient having the order greater than or equal to the second preset order so as to obtain the first high-frequency component signal.

Alternately, the calculation module 406 is further configured to perform the wavelet transform of the first preset order on the signal to be detected by the following formula:

$$(a_1, a_2, \ldots, a_K, b_1, b_2, \ldots, b_K) = \Gamma(y(n), K)$$

where, y(n) is the signal to be detected; Γ(y(n),K) represents a K-order wavelet transform on the signal y(n); $a_k$ and $b_k$ respectively represent a k-th order low-frequency coefficient and high-frequency coefficient of the signal y(n) being subjected to the wavelet transform, k is a positive integer, and n is the serial number of the tag of the signal to be detected. Specifically, the wavelet basis function adopts the 6-order Daubechies basis function, and the value of K may range between 10-13.

Alternately, the calculation module 406 is further configured to set the first low-frequency coefficient to zero by the following formula:

$$\hat{a}_k=0,(k=1,2,\ldots,K).$$

Alternately, the calculation module 406 is further configured to set the first high-frequency coefficient having the order less than the second preset order to zero by the following formula:

$$\hat{b}_k=0,(k=1,2,\ldots,K-1).$$

In terms of effect, setting the first high-frequency coefficient having the order less than the second preset order to zero is equivalent to the following formula:

$$\hat{b}_K=b_K.$$

Alternately, after setting each of the first low-frequency coefficients to zero and setting the first high-frequency coefficient having the order less than the second preset order to zero, the calculation module 406 is further configured to perform the inverse wavelet transform on the first high-frequency coefficient having the order greater than or equal to the second preset order by the following formula:

$$\hat{y}_{H,K}(n)=\Gamma^{-1}(\hat{a}_1,\hat{a}_2,\ldots,\hat{a}_K,\hat{b}_1,\hat{b}_2,\ldots,\hat{b}_K)$$

where, $\hat{y}_{H,K}(n)$ is the first high-frequency component signal corresponding to the signal to be detected.

It should be noted that each of the above modules may be implemented by software or hardware. For the latter, it may be implemented by, but not limited to, the following way: the above modules are all located in the same processor; or the above modules may be distributed in different processors in form of any combinations thereof.

In an embodiment of the present disclosure, an electronic apparatus is provided.

Figure 5:
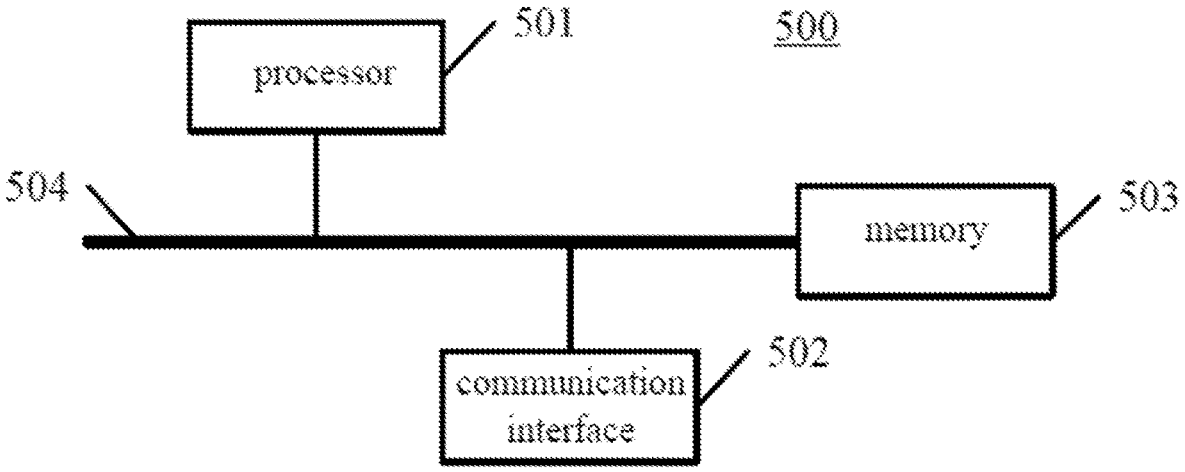
FIG. 5 schematically illustrates a structural block diagram of an electronic apparatus provided by an embodiment of the present disclosure.

FIG. 5 schematically illustrates a structural block diagram of an electronic apparatus provided by an embodiment of the present disclosure.

With reference to what's shown in FIG. 5, the electronic device 500 provided by the embodiment of the present disclosure includes a processor 501, a communication interface 502, a memory 503 and a communication bus 504. The processor 501, the communication interface 502, and the memory 503 communicate with each other through the communication bus 504. The memory 503 is configured to store computer programs, and the processor 501 is configured to execute the programs stored in the memory to implement the steps in any of the above-mentioned method embodiments.

Alternately, the above-mentioned electronic apparatus may further include a transmission device and an input and output device which is connected to the above-mentioned processor.

Alternately, in the present embodiment, the above-mentioned processor may be configured to execute the following steps by means of computer programs:

S202: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order;

S204: performing an inverse wavelet transform on the first high-frequency coefficient having an order greater than or equal to a second preset order so as to obtain a first high-frequency component signal corresponding to the signal to be detected;

S206: calculating a first Mel cepstrum feature of the first high-frequency component signal in units of frame, and concatenating the first Mel cepstrum features of a current frame signal and a preset number of frame signals before the current frame signal of the first high-frequency component signal so as to obtain a first concatenating feature; and S208: performing a detection of the tampering audio on the first concatenating feature by means of a deep learning model, where the deep learning model has been trained, has learned and stored a correspondence between the first concatenating feature of the frame signals and whether the frame signals belong to the tampering audio.

In an embodiment of the present disclosure, a computer-readable storage medium is further provided. The above-mentioned computer-readable storage medium stores the computer programs thereon, and the computer programs, when being executed by a processor, implement the steps in any of the above-mentioned method embodiments.

Alternately, in the present embodiment, the above-mentioned storage medium may be configured to store computer programs that execute the following steps:

S202: acquiring a signal to be detected, and performing a wavelet transform of a first preset order on the signal to be detected so as to obtain a first low-frequency coefficient and a first high-frequency coefficient corresponding to the signal to be detected, the number of which is equal to that of the first preset order;

S204: performing an inverse wavelet transform on the first high-frequency coefficient having an order greater than or equal to a second preset order so as to obtain a first high-frequency component signal corresponding to the signal to be detected;

S206: calculating a first Mel cepstrum feature of the first high-frequency component signal in units of frame, and concatenating the first Mel cepstrum features of a current frame signal and a preset number of frame signals before the current frame signal of the first high-frequency component signal so as to obtain a first concatenate feature; and S208: performing a detection of the tampering audio on the first concatenating feature by means of a deep learning model, where the deep learning model has been trained, has learned and stored a correspondence between the first concatenating feature of the frame signals and whether the frame signals belong to the tampering audio.

The computer-readable storage medium may be included in the apparatus/device described in the above embodiments, or it may exist alone without being assembled into the apparatus/device. The above-mentioned computer-readable storage medium carries one or more programs, and the computer programs, when being executed by a processor, implement the method according to the embodiments of the present disclosure.

According to an embodiment of the present disclosure, the computer-readable storage medium may be a non-volatile computer-readable storage medium, for example, may include but not limited to a portable computer disk, a hard disk, a random access memory (RAM), a read-only memory (ROM), an erasable programmable read-only memory (EPROM or flash memory), a portable compact disk read-only memory (CD-ROM), an optical storage device, a magnetic storage device, or any suitable combinations of the above. In the present disclosure, the computer-readable storage medium may be any tangible medium that contains or stores programs, and the program may be used by or in combination with a system, a device, or equipment executed by instructions.

Alternately, for specific examples of the present embodiment, reference may be made to the examples described in the above-mentioned embodiments and alternative implementations, and details are not described herein again in the present embodiment.

Obviously, those of skill in the art should understand that the above-mentioned modules or steps of the present disclosure may be implemented by a general computing device, and they may be integrated on a single computing device or distributed in a network composed of a plurality of computing devices. Alternately, they may be implemented with program codes executable by the computing device, such that they may be stored in a storage device for execution by the computing device. In some cases, the steps shown or described herein may be executed in a different order. The steps shown or described herein also may be implemented by being manufactured into individual integrated circuit modules, respectively, or a plurality of modules or the steps therein may be implemented by being manufactured into a single individual integrated circuit module. In this way, the present disclosure is not limited to any specific combinations of hardware and software.

The foregoing descriptions are only preferred embodiments of the present disclosure, and are not intended to limit the present disclosure. For those of skill in the art, the present disclosure may have various modifications and alternations. Any modification, equivalent replacement, improvement, etc. made within the principles of the present disclosure shall be included in the protection scope of the present disclosure.

What is claimed is:

1. A method for detecting audio tampering, the method comprising:

acquiring a signal;

performing a wavelet transform of a first preset order on the signal so as to obtain a first set of low-frequency coefficients and a first set of high-frequency coefficients corresponding to the signal, wherein the number of coefficients in the first set of low-frequency coefficients and the number of coefficients in the first set of high-frequency coefficients are equal to the order of the first preset order;

setting each of the first low-frequency coefficients to zero, and setting the first high-frequency coefficients having an order less than a second preset order to zero, and performing an inverse wavelet transform on the first set of high-frequency coefficients having an order greater than or equal to the second preset order so as to obtain a first high-frequency component signal corresponding to the signal;

calculating a first Mel cepstrum feature of the first high-frequency component signal in units of frame;

concatenating the first Mel cepstrum features of a current signal frame and the first Mel cepstrum features of a preset number of preceding signal frames that arrived before the current signal frame so as to obtain a first concatenating feature, wherein the first Mel cepstrum features of the preset number of the preceding signal frames are obtained in a same manner as the first Mel cepstrum features of the current signal frame; and performing a detection of audio tampering on the first concatenating feature by means of a deep learning model, wherein the deep learning model has been trained, has learned and stored a correspondence between the first concatenating feature of the signal frames and whether the signal frames have been subjected to audio tempering;

wherein calculating a first Mel cepstrum feature of the first high-frequency component signal in units of frame comprises:

performing a fast Fourier transform on the first high-frequency component signal so as to obtain a transformation result;

calculating a second Mel cepstrum feature of the transformation result in units of frame; and performing a discrete cosine transform on the second Mel cepstrum feature so as to obtain the first Mel cepstrum feature;

wherein calculating a second Mel cepstrum feature of the transformation result in units of frame comprises calculating a second Mel cepstrum feature of the transformation result according to the following formula:

$$X_{Mel}(i) = \log\left(\sum_{f=1}^{F} H_i(f)|X(f)|^2\right),\ 1 \le i \le a,$$

wherein, X(f) is the transformation result; |X(f)| is a norm operation of X(f); F is the number of frequency bands; f is a serial number of the frequency bands; i is a serial number of a Mel filter; $H_i(f)$ is a value of an i-th Mel filter in an f-th frequency band; a is a positive integer greater than 1; and $X_{Mel}(i)$ is the second Mel cepstrum feature corresponding to the i-th Mel filter.

2. The method according to claim 1, wherein performing a discrete cosine transform on the second Mel cepstrum feature so as to obtain the first Mel cepstrum feature comprises performing a discrete cosine transform on the second Mel cepstrum feature according to the following formula:

$$X_C(l) = \sum_{i=1}^{a} X_{Mel}(i)\cos\left(\frac{\pi l(i-1.5)}{a}\right),\ 1 \le l \le b$$

wherein, i is a serial number of the Mel filter;

$X_{Mel}(i)$ is the second Mel cepstrum feature corresponding to the i-th Mel filter;

b is a positive integer greater than 1;

I is a feature index corresponding to the second Mel cepstrum feature; and $X_C(l)$ is the first Mel cepstrum feature when the value of the feature index is I.

3. The method according to claim 1, wherein the method further comprises:

acquiring a training signal, and performing the wavelet transform of the first preset order on the training signal so as to obtain a second set of low-frequency coefficients and a second set of high-frequency coefficients corresponding to the training signal, wherein a number of coefficient in the second set of low-frequency coefficients and a number of coefficients in the second set of high-frequency coefficients are equal to the order of the first preset order;

setting each of the first low-frequency coefficients to zero, and setting the first high-frequency coefficient having an order less than a second preset order to zero, and performing the inverse wavelet transform on the second high-frequency coefficient having an order greater than or equal to the second preset order so as to obtain a second high-frequency component signal corresponding to the training signal;

calculating a third Mel cepstrum feature of the second high-frequency component signal in units of frame;

concatenating the third Mel cepstrum features of a current signal frame and the third Mel cepstrum features of a preset number of preceding signal frames that arrived before the current signal frame of signal so as to obtain a second concatenating feature, wherein the third Mel cepstrum features of the preset number of the preceding signal frames are obtained in a same manner as the third Mel cepstrum features of the current signal frame; and labeling the second concatenating feature according to the training signal and training the deep learning model according to the second concatenating feature that have been subjected to labeling.

4. The method according to claim 1, wherein, before performing a fast Fourier transform on the first high-frequency component signal so as to obtain a transformation result, the method further comprises:

constructing a down-sampling filter using an interpolation algorithm, wherein the down-sampling filter adopts a preset threshold as a multiple of down-sampling; and filtering the first high-frequency component signal according to the down-sampling filter.

5. An electronic apparatus, comprising: a processor, a communication interface, a memory, and a communication bus, wherein, the processor, the communication interface, and the memory communicate with each other through the communication bus;

the memory is configured to store computer programs, and the processor is configured to execute the computer programs stored on the memory so as to implement the method according to claim 1.

6. A non-transitory computer-readable storage medium having computer programs stored thereon, wherein the computer programs, when being executed by a processor, implement the method according to claim 1.

* * * * *